US005467487A

United States Patent [19]

Sicard

[11] Patent Number: 5,467,487

[45] Date of Patent: Nov. 21, 1995

[54] PORTABLE MULTIPURPOSE BEACH TOWEL APPARATUS

[76] Inventor: Pamela J. Sicard, 4 River Bend, Colchester, Vt. 05446

[21] Appl. No.: 358,416

[22] Filed: Dec. 19, 1994

[51] Int. Cl.[6] ..... A47G 9/02

[52] U.S. Cl. ..... 5/419; 383/4; 190/2

[58] Field of Search ..... 5/417, 420; 190/2; 383/4

[56] References Cited

U.S. PATENT DOCUMENTS

| | | | |
|---|---|---|---|
| 1,222,563 | 4/1917 | Rosenberg | 5/419 |
| 2,045,784 | 6/1936 | Leve | 5/419 |
| 4,101,994 | 7/1978 | Hoyt | 5/419 |
| 4,164,275 | 8/1979 | Davis | 5/417 |
| 4,375,111 | 3/1983 | Hall | 5/419 |
| 5,072,467 | 12/1991 | Hunt | 5/417 |
| 5,199,120 | 4/1993 | Holmes | 5/419 |
| 5,361,435 | 11/1994 | Reeves | 5/419 |

*Primary Examiner*—Michael F. Trettel
*Attorney, Agent, or Firm*—Thomas N. Neiman

[57] ABSTRACT

The novel portable multipurpose beach towel apparatus is comprised of an apparatus that is capable of providing the user with a great amount of flexibility, usefulness and simplicity in a small compact unit and at the same time provide optimum comfort for the individual. The apparatus is comprised of an extra long terry, absorbant cloth towel for use as a beach towel. At one end of the beach towel is an opening that functions as a duffel bag that can hold extra clothes and also encases an inflatable pillow that will provide extra comfort to the user. A flip out storage pouch provides space and easy access to accessories such as, suntan lotion, sunglasses and the like. The entire apparatus can be rolled up and used as a carry bag via the attached shoulder straps that leave the user's hands free.

2 Claims, 1 Drawing Sheet

PORTABLE MULTIPURPOSE BEACH TOWEL APPARATUS

BACKGROUND OF THE INVENTION

This invention pertains to beach towels and accessories, and, in particular, to a portable multipurpose beach towel apparatus which will allow an individual to carry all his or her beach items in one compact unit and, at the same time, have a towel apparatus with an inflatable pillow which will provide comfort while at the beach.

The desire for people to spend time at the beach and at warm locations for vacations is a habit that is prevalent throughout the world and it is also very common for people to walk, bicycle or rollerblade to the beach. One of the difficulties is the number of items required to protect the individual from the sun and, at the same time, provide comfort. Items such as sun glasses and sunscreen, extra clothes and snacks and fluids are often brought to the beach. Units designed for the beach have been produced in many different forms. Examples of these devices include the U.S. Pat. No. 4,856,912 to Diane Dumas for a Combination Beach Towel and Tote Bag, issued on 15 Aug. 1989 and the U.S. Pat. No. 4,738,545 issued to Marta Westgor, for a Combined Mat and Carrying Bag Unit issued on 19 Apr. 1988. Both of these devices are devices that are used at beaches which provide carrying devices and beach towels for individual. Neither device provide the complete package that the applicant's device has, all in a single unit that is compact, extremely portable and comfortable. What is needed is a portable multipurpose beach towel apparatus that an individual can easily fold and store and, at the same time, be readily accessible for use quickly and simply.

Clearly, it is desirable for an apparatus of this type to be very lightweight and adaptable. At the same time, the apparatus should be easy to manufacture and be produced of inexpensive material. It is also ideal that the apparatus be useful for companies in the area of promotional opportunities in that their messages or logos can be screenprinted on the apparatus. It is an object of this invention to set forth a portable multipurpose beach towel apparatus which avoids the disadvantages, previously mentioned limitations of typical combination beach towels.

SUMMARY OF THE INVENTION

Particularly, it is the object of this invention to set forth a portable multipurpose beach towel apparatus, for use by individuals as an all purpose carry all to and from the beach and by companies as promotional items by having messages or logos screenprinted on the apparatus, comprising a towel having at least one layer of absorbant material; said towel having side portions; said towel further having end portions with a length shorter than said side portions; said towel further having an open area at one end of said end portions of said towel which operates as a duffel bag for the storage of extra items for use at the beach; said towel further having an inflatable head rest means located at said open area of said towel; said towel further having fold out storage means located within said open area of said towel; and carrying means.

BRIEF DESCRIPTION OF THE INVENTION

Further objects and features of this invention will become more apparent by reference to the following description taken in conjunction with the accompanying figures, in which.

DESCRIPTION OF THE PREFERRED EMBODIMENTS

Figure 2:
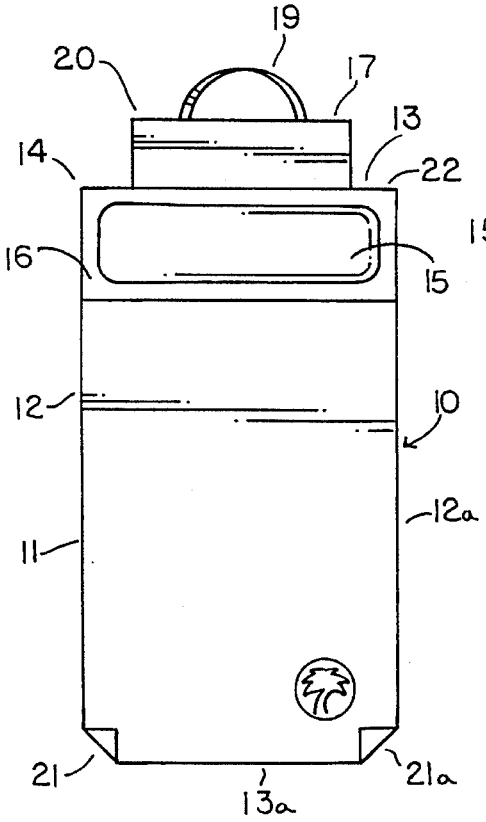
FIG. 2 is a top plan view thereof.
Figure 1:
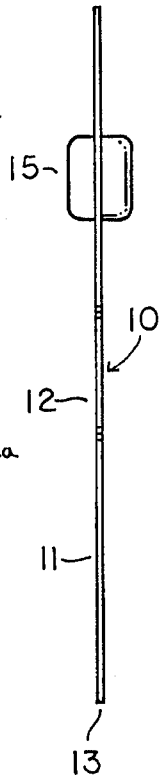
FIG. 1 is a side (either) elevational view of the novel portable multipurpose beach towel apparatus thereof, the opposite side being a mirror image thereof.
Figure 3:
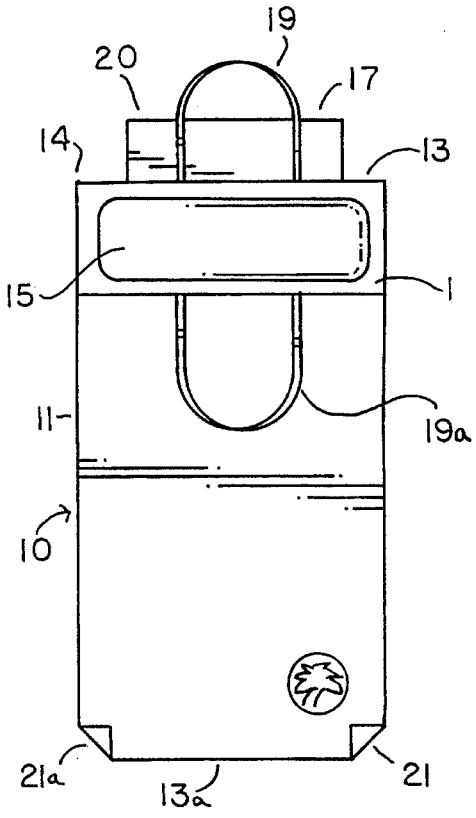
FIG. 3 is a bottom plan view thereof.
Figure 4:
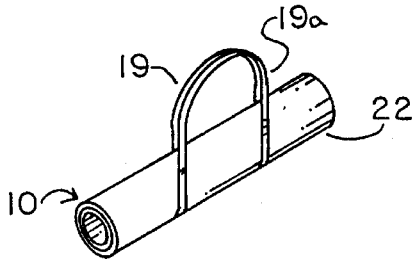
FIG. 4 is a perspective view of the novel apparatus rolled up in the carrying position.

As shown in the figures, the novel portable multipurpose beach towel apparatus 10 comprises towel 11 which is made up of layers of absorbant material such a terrycloth cotton. The towel 11 is formed in the shape of a rectangle having twin longer side portions 12 and **12*a* and twin shorted end portions 13 and 13*a*. At one end 13 of the towel 11 has a zippered opening. The inner surface 22 of the open area is constructed of waterproof material and acts as a duffel bag for extra items, such as clothes or towels or food and drink and also stores the inflatable pillow 15 and is opened or closed by the zipper 14. A pull out storage pouch 17 is located within the open area 16. The storage pouch 17 is waterproofed and is designed to carry sunscreen and sunglasses and the like. The storage pouch 17 is closed by the use of a zipper 20. Carrying handles 19 and 19*a* are attached. At the end 13*a* of the towel 11 opposite the open end 13, two sand pouches 21 and 21*a* are located at each corner. These pouches 21 and 21*a* allow the user to fill them with sand to keep the towel to be spread out in a predetermined position and to maintain the towel 11** in that position no matter the wind conditions.

The portable multipurpose beach towel apparatus is designed to provide an extra large beach towel made of terry cloth for comfort. It has an inflatable pillow that provides extra comfort and can be removed for cleaning. A fold out pouch located in the interior open area provides storage space for sunscreen, sunglasses and magazines which keeps them available for easy access and clean and dry. The open area functions as a duffel bag that provides a large storage area for extra clothes or the like. To turn the entire apparatus into a carry bag, the user simply will roll the apparatus up from the end **13*a* with the sand pouches 21 and 21*a* and join the two attached handle 19 and 19*a* together and the apparatus 10** is ready to go.

While I have described my invention in connection with specific embodiments thereof, it is clearly to be understood that this is done only by way of example and not as a limitation to the scope of my invention as set forth in the objects thereof and in the appended claims.

I claim:

1. A portable multipurpose beach towel apparatus, for use by individuals as an all purpose carry all to and from the beach and by companies as promotional items by having messages or logos screenprinted on the apparatus, comprising:

a towel having at least one layer of absorbent material;

said layers of absorbent materials comprising layers of terrycloth type material;

said towel having side portions;

said towel further having end portions with a length shorter than said side portions comprising a rectangular design;

said towel further having an open area at one of said end portions of said towel which operates as a duffel bag for the storage of extra items for use at the beach;

said open area at one of said end portions having enclosing means for encasing items kept within said open area;

said enclosing means comprising zippers;

the other of said end portions having pockets located at each corner of said end portion for receiving sand for maintaining said end portion from being blown by the wind and for enabling said apparatus to be maintained in a desired position;

said towel further having inflatable head rest means comprising a pillow located at said open area of said towel;

said pillow having means for withdrawal of said pillow from said open area for allowing the cleaning of said apparatus;

said towel further having fold out storage means located within said open area of said towel;

said fold out storage means comprising a water proof pouch;

said fold out storage means having closing means;

said fold out storage closing means comprising zipper; and carrying means.

2. A portable multipurpose beach towel apparatus, according to claim 1, wherein:

said carrying means comprises attached handle means for supporting said portable multipurpose beach towel apparatus when the apparatus is rolled up from the bottom to the top and then joining said attached handles together to securely encase and carry said portable multipurpose beach towel apparatus.

* * * * *